United States Patent [19]

Champ et al.

[11] Patent Number: 4,889,784

[45] Date of Patent: Dec. 26, 1989

[54] ORGANIC PHOTOCONDUCTORS WITH IMPROVED WEAR

[75] Inventors: Robert B. Champ, Boulder, Colo.; Meredith D. Shattuck, Hollister, Calif.; Donald A. Stremel, No. Glen, Colo.

[73] Assignee: International Business Machines, Armonk, N.Y.

[21] Appl. No.: 262,397

[22] Filed: Oct. 25, 1988

[51] Int. Cl.[4] ..... G03G 5/04

[52] U.S. Cl. ..... 430/58; 430/59

[58] Field of Search ..... 430/58, 59

[56] References Cited

U.S. PATENT DOCUMENTS

| | | | |
|---|---|---|---|
| 4,026,704 | 5/1977 | Rochlitz et al. | 430/57 |
| 4,082,551 | 4/1978 | Steklenski et al. | 430/64 |
| 4,388,392 | 6/1983 | Kato et al. | 430/58 |
| 4,513,073 | 4/1985 | Jeffrey, III et al. | 430/65 |
| 4,727,009 | 2/1988 | Takai | 430/59 X |
| 4,772,526 | 9/1988 | Kan et al. | 430/58 |

*Primary Examiner*—Paul R. Michl
*Assistant Examiner*—Jeffrey A. Lindeman
*Attorney, Agent, or Firm*—Joseph G. Walsh

[57] ABSTRACT

An organic photoconductor comprising a charge generation layer and on top thereof a charge transport layer having a higher concentration of charge transport molecules nearer the charge generation layer than in the topmost portion.

4 Claims, No Drawings

ORGANIC PHOTOCONDUCTORS WITH IMPROVED WEAR

DESCRIPTION

1. Technical Field

The present invention is concerned with organic photoconductors having improved wear without any degradation in electrophotographic properties.

2. Background Art

U.S. Pat. No. 4,082,551 discloses the use of multilayer photoconductor structure beneath the photoconductive transport layer which prevents electrical interaction between the conductive support and the transport layer.

U.S. Pat. No. 4,254,199 discloses a polymer photoconductor placed between two charge generating layers which when alternatively charged and discharged across the transport layer, create the imaging potential across the charge generation and carrier layers only.

U.S. Pat. No. 4,388,392 discloses the use of a homogenous composition of polycyclic aromatic hydrocarbon and polyvinyl carbazole to provide a charge transport layer with improved mechanical properties.

U.S. Pat. No. 4,513,073 discloses the use of two space charge layers sandwiching a photoconductive layer in order to enhance the applied electric field on the photoconductor and increase the quality of the copied image. The space charge layers are typically n or p type silicon deposited on a preferred insulating blocking layer of silicon suboxide.

U.S. Pat. No. 4,026,704 discloses an organic photoconductive double layer where the top layer photoconducting substance is 40–60% by weight and the base layer has only 5–10% by weight of the substance. The resulting double layers are said to produce increases in sensitivity of up to five times that achieved with a single layer. The patent shows (see col. 2, line 15) a charge transport layer, the top portion of which contains a higher concentration of charge transport material than is present in the bottom layer. The present invention goes directly against the teaching of this prior art patent.

DISCLOSURE OF THE INVENTION

According to the present invention, organic photoconductors with improved wear characteristics are obtained by using a charge transport layer which has a higher concentration of charge transport material in the bottom portion than it does in the top portion. The top and bottom portions may be separate layers or alternatively, there may be a single layer with a concentration gradient therein. In both cases, the important feature is that the concentration of charge transport material be higher on the bottom, i.e., the portion near the charge generation layer, than it is on the top.

At the present time, organic photoconductors have a higher wear rate than desired. The present invention provides a solution to this problem and results in photoconductors having significantly improved wear characteristics without any observable degradation in electrophotographic properties.

In practice, the preferred embodiment of the present invention requires the use of two charge transport layers. The layer next to the charge generation layer is rich in charge transport material while the outermost layer is relatively lean. A common solvent is preferably used to form both layers. The use of such a common solvent results in intermixing and yields a graded concentration of charge transport material.

There are many known charge transport materials which are in common use. Examples of these materials include 4-diethylaminobenzaldehyde diphenylhydrazone (DEH); bis(4-N,N-diethylamino-2-methyl phenyl)-phenyl methane; N,N'-diphenyl-N,N'-bis(3-methyl phenyl)-[1,1'-biphenyl]-4,4'-diamine; N-phenyl-N-methyl-3(3-ethyl) carbazyl hydrazone; 2,5 bis (4-N,N'-diethylaminophenyl) 1,2,4-oxadiazole; and 1-phenyl-3-diethylaminostyryl-5-diethylaminophenyl pyrazoline.

There are also many known polymeric binders for charge transport layers. These include, for example, polycarbonate, polyesters and polyarylates.

The present invention is applicable to all such charge transport agents and polymer binders. Furthermore, it is not necessary to use the same binder for both layers.

The optimum proportions vary somewhat with the particular ingredients used, i.e., with the particular charge transport material and the particular polymer binder. In general, however, the concentration of charge transport material at the bottom, i.e. near the charge generation layer, may be any concentration which does not interfere with the mechanical properties. Concentration of up to 80% are possible. In general, it is preferred to use concentrations of from 80% to 30%. In the outermost or top region of the charge transport layer there need be no charge transport agent at all. The approximate thickness of the entire layer is generally on the order of about 20 microns.

The following Examples are given solely for purposes of illustration, and are not be considered limitations of the present invention, many variations of which will occur to those skilled in the art, without departing from the scope or spirit thereof.

EXAMPLE 1

A graded transport layer was prepared in which the layer adjacent to the charge generation layer was 20 parts polycarbonate and 80 parts DEH. The top layer was 80 parts polycarbonate and 20 parts DEH. The layer adjacent to the charge generation layer was approximately three times as thick as the top layer. (Total transport layer thickness was ~20μ.)

A squaric acid methane dye as described in U.S. Pat. No. 3,824,099 in a polymeric binder was used as a charge generation layer.

| Comparative Data: | Control *Single Layer | Graded |
|---|---|---|
| Volts decayed after 260 msec | 25 | 5 |
| Volts decayed after 173 msec | 50 | 14 |
| Residual potential @ 1.56 $\mu J/cm^2$ | 91 V | 95 V |
| Dark fatigue | 103 V | 53 V |
| Light fatigue | 34 V | 28 V |

*Single layer transport contained 39% DEH in a polycarbonate binder.

A graded transport evaluated for filming caused by pitting of the charge transport layer showed an order of magnitude less pitting than the single layer transport.

Results of a Taber abrasion test were:

Control-1.28 $mg/in^2$ @800 cycles

Graded-0.81 $mg/in^2$ @800 cycles

The above data shows that the graded transport has improved photoresponse and decreased wear over that obtained with the single layer transport.

EXAMPLE 2

A graded transport was prepared in which the layer next to the charge generation layer contained 40% DEH and 60% polycarbonate with an outer layer of dopant lean polyarylate. The polyarylate (Ardel D-100, Union Carbide Co.) was applied as a solution without the DEH transport dopant to the first layer. Since a common solvent (tetrahydrofuran) was used, some intermixing of the two layers occurred and a DEH lean outer layer was obtained. A squaric acid methane dye in a polymeric binder was used as the charge generation layer.

Evaluation of the transport layer in a Taber abrasion wear test showed that the graded transport had about 4 mg. weight loss while the single layer control had about 11 mg. weight loss. The electrophotographic properties of the two transports were equal.

We claim:

1. An organic photoconductor comprising a charge generation layer and on top thereof a charge transport layer in which the total concentration of the charge transport material is from 80% to 30% in that portion which is nearer the charge generation layer and is at least 30% less in that portion which is farther away from the charge generation layer.

2. An organic photoconductor as claimed in claim 1 in which the charge transport layer contains two separate portions, the bottom one of which has a 80% to 30% total concentration of charge transport material and a top layer having a total concentration of charge transport material at least 30% less than in the bottom layer.

3. An organic photoconductor as claimed in claim 1 in which the charge transport material is 4-diethylaminobenzaldehyde diphenylhydrazone.

4. An organic photoconductor as claimed in claim 1 in which the charge transport layer comprises a polycarbonate binder.

* * * * *